US006626286B2

(12) United States Patent
Boutet et al.

(10) Patent No.: US 6,626,286 B2
(45) Date of Patent: Sep. 30, 2003

(54) CONTAINER FOR LARGE-CALIBRE AMMUNITION

(75) Inventors: Claude Boutet, Bourges (FR); Thierry Fougeroux, Saint Eloy De Gy (FR)

(73) Assignee: Giat Industries, Versailles (FR)

( * ) Notice: Subject to any disclaimer, the term of this patent is extended or adjusted under 35 U.S.C. 154(b) by 8 days.

(21) Appl. No.: 09/914,387

(22) PCT Filed: Jan. 17, 2001

(86) PCT No.: PCT/FR01/00137

§ 371 (c)(1),
(2), (4) Date: Aug. 28, 2001

(87) PCT Pub. No.: WO01/53772

PCT Pub. Date: Jul. 26, 2001

(65) Prior Publication Data

US 2002/0134693 A1 Sep. 26, 2002

(30) Foreign Application Priority Data

Jan. 19, 2000 (FR) ..... 00 00811

(51) Int. Cl.[7] ..... F42B 39/00; B65D 19/00; B65D 21/00

(52) U.S. Cl. ..... 206/3; 206/509; 206/446; 206/386

(58) Field of Search ..... 206/3, 317, 443, 206/446, 504, 505, 506, 509, 510, 511, 804, 821; 220/4.26, 4.27, 756, 23.07, 23.08, 528, 769, 386

(56) References Cited

U.S. PATENT DOCUMENTS

| | | | | |
|---|---|---|---|---|
| 3,631,969 A | * | 1/1972 | Lacoste et al. | 206/3 |
| 4,429,929 A | * | 2/1984 | Stepp | 206/443 |
| 4,538,723 A | * | 9/1985 | Johnson et al. | 206/3 |
| 4,733,773 A | | 3/1988 | LaBianca et al. | |
| 4,807,756 A | * | 2/1989 | Young et al. | 206/509 |
| 5,193,706 A | * | 3/1993 | Hanna et al. | 220/324 |
| 5,465,865 A | | 11/1995 | Coombes | |
| 5,779,031 A | | 7/1998 | Moraine et al. | |

FOREIGN PATENT DOCUMENTS

| | | |
|---|---|---|
| DE | 40 14 193 A1 | 11/1991 |
| EP | 0 061 255 A2 | 9/1982 |
| FR | 2 477 698 | 9/1981 |
| FR | 2 685 469 | 6/1993 |
| FR | 2 753 265 A1 | 3/1998 |

* cited by examiner

*Primary Examiner*—Mickey Yu
*Assistant Examiner*—J. Gregory Pickett
(74) *Attorney, Agent, or Firm*—Oliff & Berridge, PLC

(57) ABSTRACT

A container including a body incorporating at least one cell able to receive an ammunition element, the body also having two side faces as well as a lower face and an upper face having matching shapes forming a Positioning device allowing one container to be positioned with respect to another one stacked onto it, the container also incorporating a joining device allowing the container to be linked to another container stacked onto it.

13 Claims, 5 Drawing Sheets

CONTAINER FOR LARGE-CALIBRE AMMUNITION

Figure 1:
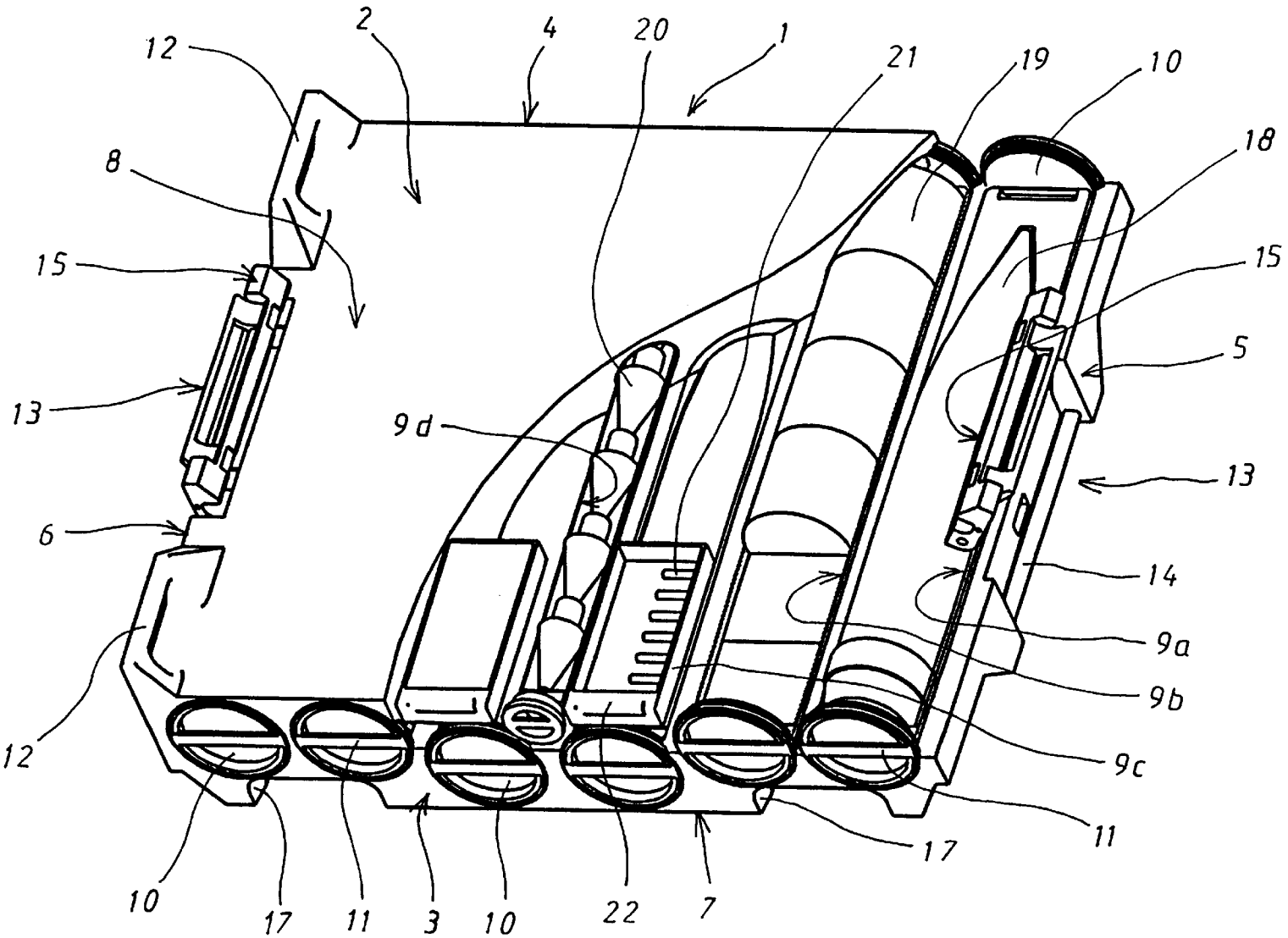

The technical scope of the present invention is that of containers for large calibre a or ammunition, in particular for field artillery ammunition.

Present-day large calibre field artillery ammunition is classically composed of a projectile and a propellant charge, elements which are independent and are stored separately.

In long-term storage depots, projectiles are generally stored upright in large quantities, on a wooden pallet and are held on by one or several hoops wrapped around both the projectiles and the pallet. The propellant charges are stored in single or double air-tight containers, stacked on a wooden pallet and held in place by one or several hoops. The containers are of the type described, for example, in patents FR2477698 or FR2685469.

During the preparations for a field operation, the projectiles are taken from their depot storage and unfastened (removal of the hoops), and are then manually transferred into a first type of artillery equipment or support truck storage case. The projectile are held in place in these cases by immobilising devices, of the type described in patent FR2753265. As for the charges, they are left inside their containers. The charge containers are manually transferred into a second type of storage case ensuring their immobilisation.

Artillery projectiles incorporate a fuse screwed to the nose. There are different types of fuse (timer, impact, proximity . . . ) according to the type of target.

These are installed onto the projectiles just before the ammunition is loaded into the gun barrel, depending on the type of target to be attacked. The different fuses are stored on the artillery equipment in a third type of case.

Artillery ammunition is generally fired using squibs. These squibs are also stored on the artillery equipment in a fourth type of case.

Preparation occasionally comprise a supplementary intermediary phase consisting in grouping full rounds on a pallet, that is to say the same number of projectile as propellant charges as well as their corresponding fuses and squibs.

Thus, the preparation of a field operation requires substantial handling operations to supply the equipment.

Moreover, operating in the field, the operator picks out the different elements required for firing (projectile, propellant charge, fuse, squib) from four different cases, which are generally not grouped together.

Present-day logistics, therefore, require ammunition storage means for long-term storage depots that are different from the storage and transfer means for artillery equipment during field operations. This requires a lot of handling of the ammunition with the subsequent risks to safety and of supply errors.

Patent EP-61255 describes a large calibre artillery ammunition storage container. This container incorporates two cells intended to each receive a piece of ammunition that, in this case, is a cased ammunition. On its upper face, it incorporates cavities of a matching shape to feet made on its lower face, such as to be able to co-operate with a second container. Several containers can thus be stacked on top of one another. Several rows of stacked containers can be placed on a pallet and held on by two hoops. Each container incorporates two carrying handles. These air-tight containers can be used both for depot storage and for storage and transport on a piece of artillery.

However, although they are able to be stacked on top of one another, there are no joining means provided either between them or between them and the support. It is thus still necessary to have cases to support the containers. Moreover, this container is not suitable for artillery ammunition that is composed of a projectile and propellant charge that are independent of each other with a separate fuse.

Patent DE-4014193 describes a launch container that can contain four missiles and can be stacked with another analogous container. This container has six claws on its upper face that can penetrate into matching housings on a lower face of another container.

It also incorporates four swivelling locking latches at the four corners of its upper face and co-operating with grooves made in a lower face of another container.

Such a container is complicated in design. Additionally, the relative positioning of two containers to be stacked must be relatively accurate so as to permit the hooks to match up with their housings.

Unlocking is, finally, complicated by the number and position of the latches.

The invention relates to a container to carry and store ammunition that overcomes such drawbacks.

Thus, the container according to the invention is of simple design and permits the easy stacking of the containers. It also allows the containers to be easily joined or separated.

The container according to the invention can be used both for long-term storage in a storage depot and as an ammunition case for a piece of artillery.

This container avoids the handling of each constitutive element of a piece of ammunition, the full container alone is moved from the storage depot to the piece of artillery.

The subject of the invention is thus a container for large calibre ammunition, in particular for field artillery ammunition, constituted by a body, incorporating at least one cell opening out at a front face and/or a rear face and receiving one element of an ammunition, said body having two side faces as well as a lower face and an upper face carrying matching shapes forming means to position one container with respect to another container stacked on it, said container also incorporating at least one joining means allowing it to be linked to another container stacked on it, said container characterised in that the matching shapes ensuring the positioning are arranged at each angle of the lower and upper faces of the container.

Advantageously, at least one joining means will be arranged at each of the side faces between the positioning means.

Each joining means can comprise a lug and a hinged hooking lock intended to co-operate with the lug of another container stacked on it so as to join the two containers together.

The hooking lock can incorporate a hinged locking handle comprising a tip intended to engage inside a hooking groove of the lug.

The matching shapes ensuring the positioning will advantageously be planes made on the lower and upper face of the container, planes inclined with respect to the side faces and being oriented perpendicularly to the front and rear faces.

The container can comprise at least two grooves made on the lower face of the container and intended to allow a passage for the fork of a fork-lift truck.

It can also comprise at least two carrying handles integral with the upper face of the container.

The four inclined faces of the upper face of the container can advantageously be arranged level with the carrying handles.

The container can incorporate at least two air-tight cells each able to receive a constitutive element of a piece of artillery ammunition, that is a projectile and/or a propellant charge and/or at least one fuse and/or at least one squib.

The cells can open out both onto a front face and a rear face of the container.

Each cell can be sealed by using at least one plug integral with the body.

Each cell can incorporate a sliding sleeve intended to receive at least one ammunition element and intended to permit it to be removed from the body.

Each sleeve can be constituted by two half-shells surrounding the ammunition element.

Each sleeve can incorporate a handle integral with a half-shell of the sleeve allowing it to slide with respect to the body so as to extract the ammunition element.

A first advantage of the device according to the invention lies in the use of the same container for long-term depot storage and as an ammunition case for a piece of artillery.

Another advantage is the easy quick joining of each container with its neighbouring container located above and of the lower container with the support on which it stands.

Another advantage is the facility with which each container is transported, either manually, by bridge, crane or fork-lift truck.

Another advantage lies in the fact that the container groups together at least one full round composed of a projectile, a propellant charge, a set of differentiated fuses and squibs. It thus allows the logistic operations to be simplified.

Another advantage lies in leaving the ammunition it its long-term storage container, thereby allowing those unused further to a field operation to be returned to the storage depot once again without their having to be repacked.

Another advantage is the facility of storing the ammunition obtained by stacking a great number of containers on top of one another.

Another advantage is the air-tight protection of the different constitutive elements of a piece of ammunition from storage to use.

Figure 2:
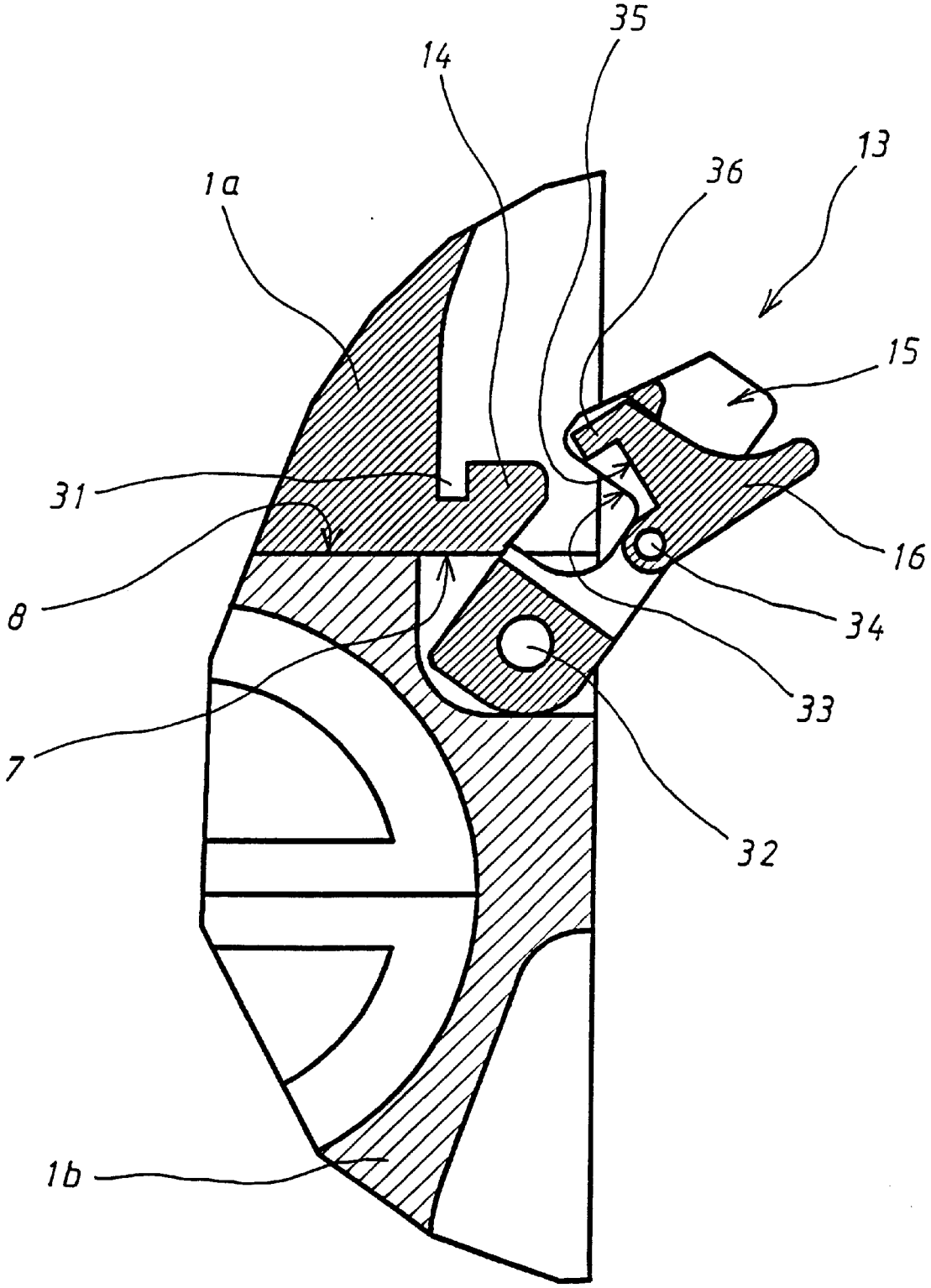
Figure 3:
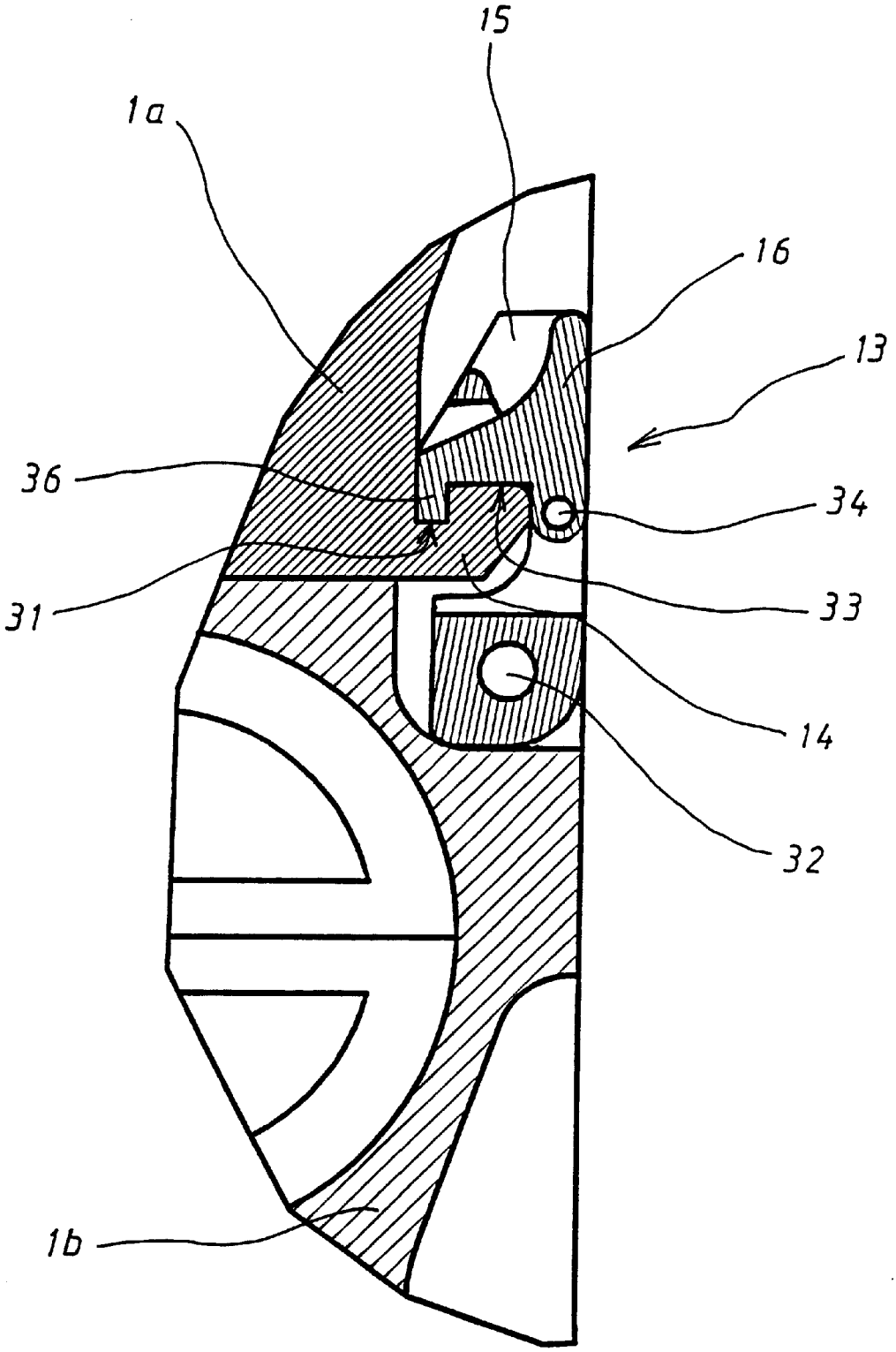
Figure 4:
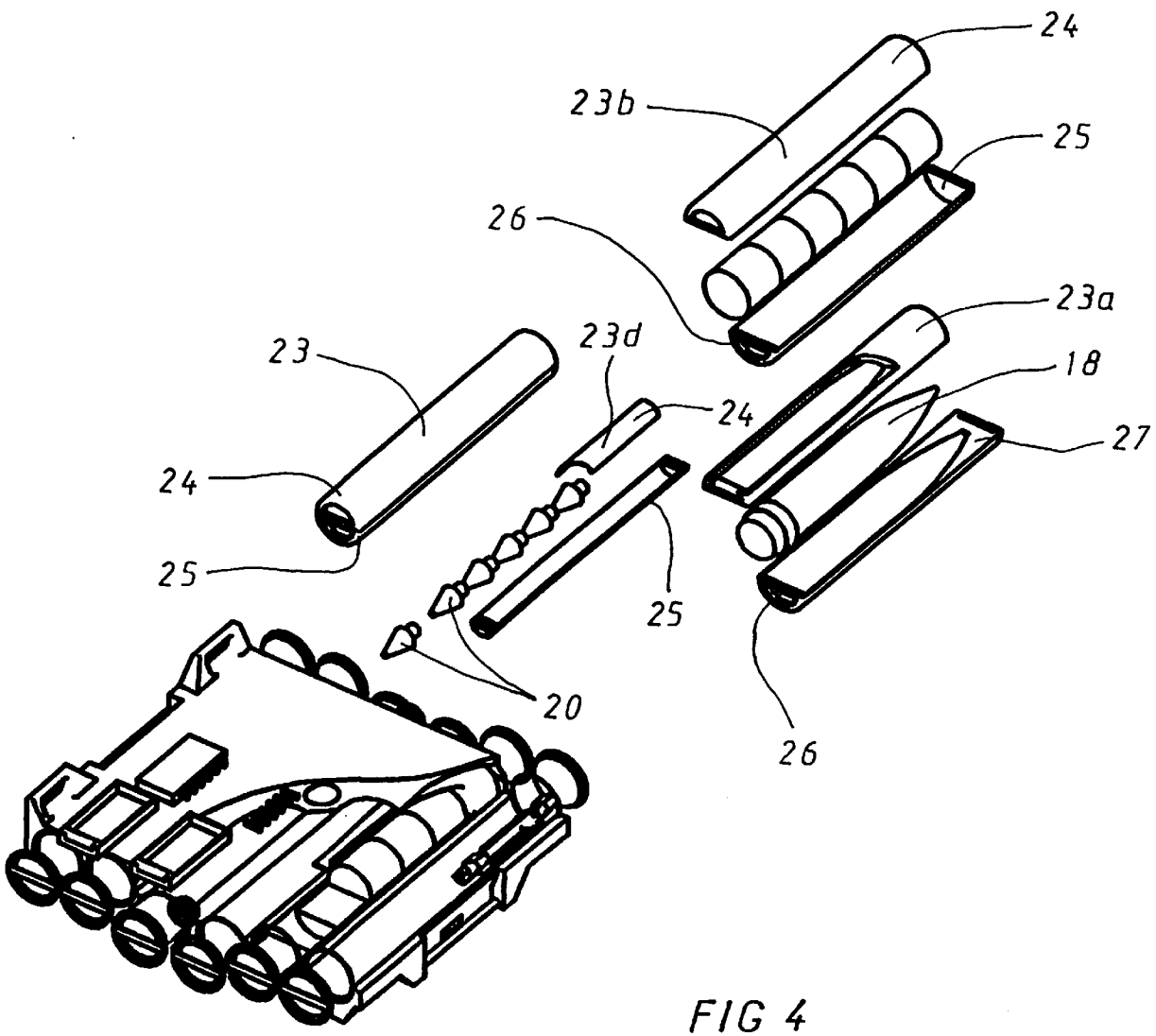
Figure 5:
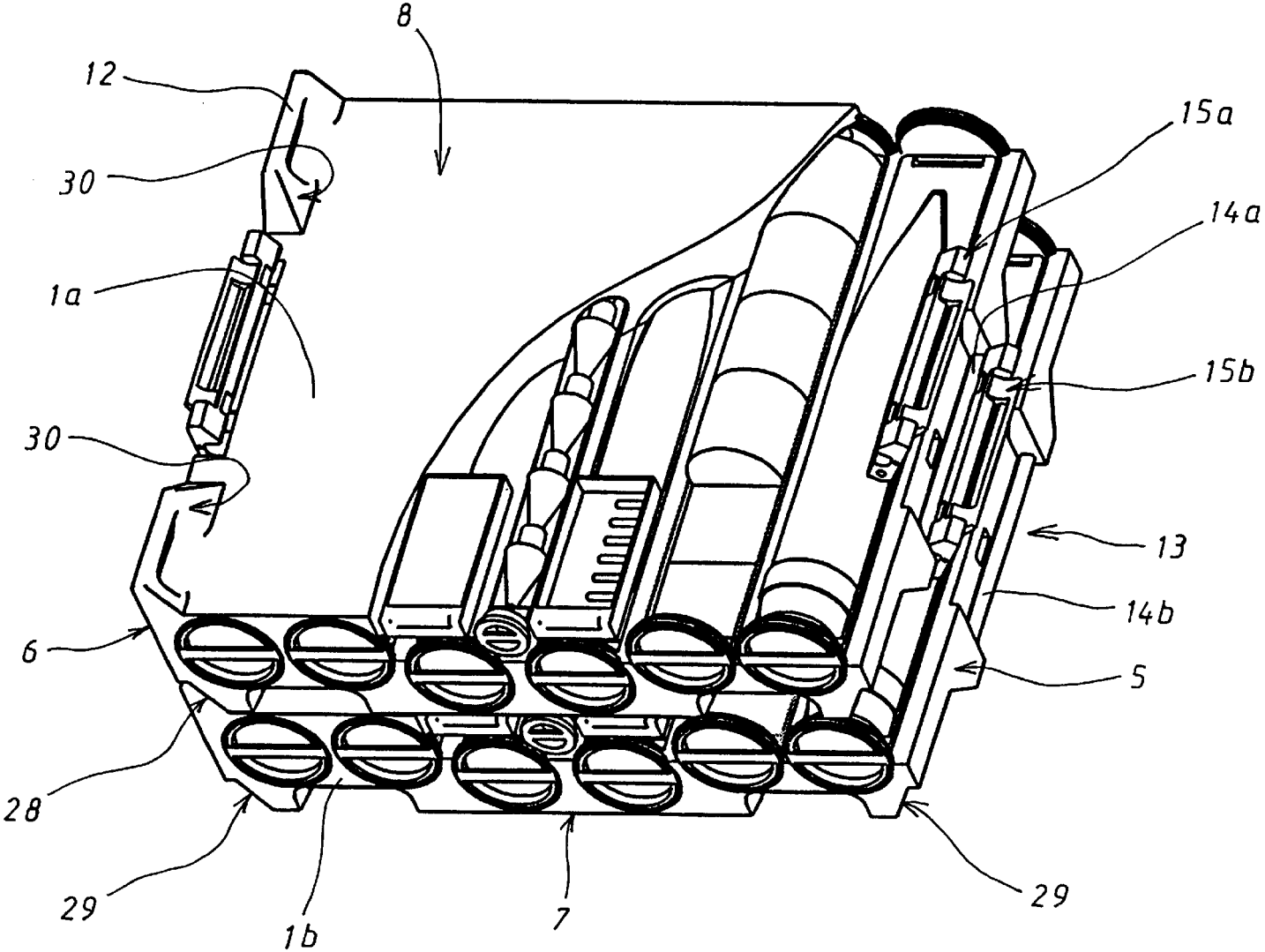

Other characteristics, particulars and advantages of the invention will become more apparent after reading the following description given by way of illustration in reference to the drawings, in which:

FIG. 1 is a perspective partial section view of a container according to the invention, FIG. 2 is a section view of the means to join two containers together, in the open position, FIG. 3 is a section view of the means to join two containers together, in the locked position, FIG. 4 is an exploded view of a container, FIG. 5 is a perspective view of two stacked containers.

A container 1 according to the invention is constituted of a substantially parallelepipedic body 2 incorporating a front face 3, a rear face 4, two side faces 5 and 6, a lower face 7 and an upper face 8. The body 2 will, for example, be made of a composite material.

The container 1 incorporates cells 9 intended to receive the constitutive elements of a large-calibre field artillery ammunition. These cells advantageously open out both onto the front face 3 and the rear face 4. They may also only open out onto a single face, preferably the front face.

The cells 9 are closed by plugs 10 screwed into the body 2 of the container. Each plug 10 incorporates a sealing ring making the cell fully air-tight.

The plugs have a tag 11 on their outer face allowing them to be manually handled so as to be screwed on unscrewed. Such a plug is described in greater detail in patents FR-2477698 and FR-2685469.

The upper face 8 of the container incorporates carrying means that here are handles 12, there being four of them arranged at an angle to the upper face 8 of the container. The handles 12 are integral with the body 2, and are, for example, moulded with the body. They are intended to allow the container to be carried, either manually by several people, or by the hook of a crane or bridge.

The side faces 5 and 6 each receive joining means 13 intended to allow two containers stacked on top of one another to be joined together.

The means 13 comprise, on each container, firstly a lug 14 integral with the body 2 and arranged in the vicinity of the lower face 7 and secondly, a hinged hooking lock 15 placed in the vicinity of the upper face 8, such lock intended to hook onto the lug 14 of the upper container.

Naturally, the means 13 arranged on each side face 5 and 6 can be of a different design.

FIG. 2 shows a section of the means 13 to join two containers 1*a* and 1*b* stacked on top of one another, means shown in the unlocked position.

The upper container 1*a* incorporates at its lower face 7 a lug 14 integral with the container body and incorporating a hooking groove 31.

The lower container 1*b* incorporates at its upper face 8, a hooking lock 15 hinged around a pin 32 integral with the container. The lock 15 incorporates a throat 33 intended to engage on the lug 14 in the locked position, as shown in FIG. 3. The lock 15 also incorporates a locking handle 16 mounted hinged on a pin 34 integral with the lock. The handle 16 comprises a recess 35 and a tip 36 intended to engage inside the hooking groove 31, the recess 35 being astride the lug 14.

Such joining means 13 operate as follows:

- the lock 15 is made to swivel around its pin 32, so as to engage the throat 33 onto the lug 14, thereby ensuring the axial linking of the two superposed containers,
- then, the handle 16 is made to swivel around its pin 34, so as to make the tip 36 penetrate inside the groove 31 of the lug 14. The handle 16 is thus locked onto the lug 14 as shown in FIG. 3.

As this operation is performed for each of the joining means 13 located on the side faces 5 and 6, the two containers 1*a* and 1*b* are made fully integral with one another.

With reference once again to FIG. 1, we can see that the bottom 7 incorporates two grooves 17 opening out onto the front 3 and rear 4 faces. They are placed in parallel to the axis of the cells 9. These grooves are intended to 35 allow a passage for the two arms of the fork of a fork-lift truck and thus constitute a lifting device for the container 1.

When several containers are stacked and joined together, they are thus able to be easily lifted by the fork of a fork-lift truck that will slip into the grooves 17 of the lower container.

As has already been mentioned previously, the different cells 9 are intended to house the constitutive elements for a piece of ammunition.

A first cylindrical cell 9*a* houses a projectile 18.

A second cylindrical cell 9*b* houses a propellant charge 19 that is here composed of several modules, for example six.

A third cell 9*c* houses squibs 21. It is made here in the form of a slide 22 incorporating recess inside which the different squibs 21 are fitted. It can naturally also be cylindrical and contain, for example, a squib drum.

A fourth cylindrical cell 9*d* houses fuses 20.

The container thus encloses a full round for an artillery ammunition.

Advantageously, the container 1 shown incorporates a number of cells allowing three full rounds to be received with fuses differentiated according to the target.

With reference to FIG. 4, we can see that each cell incorporates a sleeve 23 formed of two half-shells 24 and 25.

The sleeves 23 are intended to facilitate the extraction of the ammunition elements from the cells. For this, they are mounted sliding inside the cells and have a handle 26 integral with the lower half-shell 25.

Each sleeve 23 is adapted to the shape of the ammunition element contained.

Thus, sleeve 23*a* incorporates a shimming device 27 matching the outer shape of the projectile nose cone 18 and made, for example, of foam.

Sleeve 23*b* of cell 9*b* does not incorporate here a shimming device. Indeed, the internal dimensions of the sleeve substantially correspond to the external dimensions of six modules 19 of assembled charge. Naturally, a shimming device would be installed if less than six modules were installed per cell.

Sleeve 23*d* also incorporates a shimming device for the fuses 20 made, for example, of foam matching the external profile of the fuses.

Lastly, the slide 22 incorporates foam having recesses intended to each accommodate a squib 21.

Thus, each ammunition element, projectiles, propellant charge modules, fuses and squibs, is tightly fitted into its respective sleeve. Such a shimming device is well known and will not be described any further.

FIG. 5 shows two containers 1*a* and 1*b* stacked on top of one another. Lock 15*b* of lower container 1*b* is shown in the unlocked position. It is intended to be hooked onto the pin 14*a* of the upper container 1*a*.

Each container also incorporates matching shapes 28 on its lower and upper faces intended to link in translation along an axis perpendicular to grooves 17 two containers stacked on top of one another.

These matching shapes are arranged at each angle of the lower 7 and upper 8 faces of the container. They comprise planes 29 inclined with respect to the lower face 7 and made at the angles of face 7 and side faces 5 and 6 of the container and intended to co-operate with identical and matching inclined planes 30 made on each carrying handle 12.

The planes are inclined with respect to the side faces 5 and 6 and are oriented perpendicularly to the front 3 and rear 4 faces. The inclined planes 29 of the upper face 8 are arranged level with the carrying handles 12.

The inclined planes are oriented such that each container, guided by the inclined planes, positions itself naturally correctly with respect to the container onto which it is being stacked. The correct positioning of the containers on top of one another is thus also ensured as is that of the joining means 13 with respect to each other.

The positioning of the joining means 13 at the side faces makes them easily accessible, both to lock and unlock the containers.

Since each side face 5 and 6 of the two containers incorporates joining means 13 and each container incorporates matching shapes 28, the two containers are perfectly positioned with respect to each other and are made integral.

The containers according to the invention can advantageously be used both for long-term storage and as ammunition cases for a piece of artillery. To do this, a single transport operation, for example using a fork-lift truck, is required between the storage depot and the piece of artillery. As the containers are joined together, several containers can thus be transported in a single operation and without the need for a pallet.

Thus, no handling of the ammunition elements is required. These remain safely packed and sealed until needed.

In the event of their not being used, the containers can be returned to the storage depot without needing to be repacked.

Advantageously, it is possible for locks 15 identical to those on the containers to be provided on the floor of the piece of artillery. These locks will thus be able to hook onto the pins 14 of a first container so as to make it integral with the floor of the piece of artillery.

As a variant, it may be arranged so that lifting a container by the forks of a fork-lift truck engaged in the grooves 17 of said container causes the automatic unlocking of the joining means 13, thanks to a linkage acting on the joining means.

It may also be arranged so that the installation of a first container onto a second container causes the automatic locking of the joining means 13.

What is claimed is:

1. A container for large calibre ammunition, comprising:

a body, incorporating at least one cell opening out at a front face and/or a rear face and receiving one element of an ammunition, said body also having two side faces as well as a lower face and an upper face, at least one of the side faces, the lower face or the upper face having at least two first shapes; and at least one joining means generally centralized with respect to the front face and the rear face and located between the at least two first shapes allowing the body to be linked to a body of a second container stacked on it, wherein the at least two first shapes cooperate and match with at least two second shapes of the second container in order to position the body with the second container, and each joining means comprises a lug and a hinged hooking lock provided on at least one of the side faces, the lower face or the upper face intended to co-operate with a lug of the second container.

2. The container according to claim 1, wherein the at least one joining means is arranged at each of the side faces between the at least two first shapes.

3. The container according to claim 1, wherein the hooking lock incorporates a hinged locking handle comprising a tip intended to engage inside a hooking groove of the lug.

4. The container according to claim 1, wherein the at least two first shapes are planes made on the upper face of the body and inclined with respect to the side faces and being oriented perpendicularly to the front and rear faces.

5. The container according to claim 1, wherein the container comprises at least two grooves made on the lower face of the body and intended to allow a passage for the fork of a fork-lift truck.

6. The container according to claim 1, wherein the container comprises at least two carrying handles integral with the upper face of the body.

7. The container according to claim 4, wherein the upper face includes four inclined faces which are level with carrying handles.

8. The container according to claim 1, wherein the container incorporates at least two air-tight cells each able to receive a constitutive element of a piece of artillery ammunition, that is a projectile and/or a propellant charge and/or at least one fuse and/or at least one squib.

9. The container according to claim 8, wherein the cells open out both onto the front face and the rear face of the body.

10. The container according to claim 8, wherein each cell is sealed by using at least one plug.

11. The container according to claim 8, wherein each cell incorporates a sliding sleeve intended to receive at least one ammunition element and intended to permit the at least one ammunition element to be removed from the body.

12. The container according to claim 11, wherein each sleeve is constituted by two half-shells surrounding the ammunition element.

13. The container according to claim 12, wherein each sleeve incorporates a handle integral with a half-shell of the sleeve allowing the sleeve to slide with respect to the body so as to extract the ammunition element.

* * * * *